US012215455B2

(12) United States Patent
Jung et al.

(10) Patent No.: US 12,215,455 B2
(45) Date of Patent: Feb. 4, 2025

(54) DIAPHRAGM ASSEMBLY AND WASHING MACHINE COMPRISING SAME

(71) Applicant: SAMSUNG ELECTRONICS CO., LTD., Suwon-si (KR)

(72) Inventors: Euihyun Jung, Suwon-si (KR); Jonghun Sung, Suwon-si (KR); Youngil Ju, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 242 days.

(21) Appl. No.: 17/749,243

(22) Filed: May 20, 2022

(65) Prior Publication Data

US 2022/0275563 A1 Sep. 1, 2022

Related U.S. Application Data

(63) Continuation of application No. PCT/KR2020/014810, filed on Oct. 28, 2020.

(30) Foreign Application Priority Data

Dec. 9, 2019 (KR) ..... 10-2019-0162859

(51) Int. Cl.
*D06F 39/12* (2006.01)
*D06F 39/08* (2006.01)

(52) U.S. Cl.
CPC ..... *D06F 39/12* (2013.01); *D06F 39/088* (2013.01)

(58) Field of Classification Search
CPC ..... D06F 39/12; D06F 39/088; D06F 37/266; D06F 23/02; D06F 37/264; D06F 37/267; D06F 39/024; D06F 39/081
(Continued)

(56) References Cited

U.S. PATENT DOCUMENTS 8,776,297 B2 * 7/2014 Im ..... D06F 21/00 8/158
9,764,363 B2 * 9/2017 Zhang ..... D06F 35/008
(Continued)

FOREIGN PATENT DOCUMENTS

CN 102733151 A * 10/2012 ..... B08B 3/02
JP 4847349 B2 12/2011
(Continued)

OTHER PUBLICATIONS

International Search Report for International Application No. PCT/KR2020/014810 dated Feb. 3, 2021.
(Continued)

*Primary Examiner* — David G Cormier
*Assistant Examiner* — Thomas Bucci
(74) *Attorney, Agent, or Firm* — STAAS & HALSEY LLP

(57) ABSTRACT

A washing machine including a body including a front frame; a tub provided inside the body; a dispenser to supply water to the tub; a diaphragm provided between the tub and the front frame, the diaphragm including a through hole formed on one side; a nozzle to spray the water toward an inside of the tub; and a supply hose formed to surround the nozzle while a portion of the nozzle is inside the through hole of the diaphragm, wherein a first side of the supply hose is formed to be coupled with the dispenser, and a second side of the supply hose is formed to extend toward an inside of the diaphragm through the through hole.

15 Claims, 6 Drawing Sheets

(58) Field of Classification Search
USPC ..... 68/212
See application file for complete search history.

(56) References Cited

U.S. PATENT DOCUMENTS 9,845,563 B2 * 12/2017 Plata Amarillas .... D06F 39/088
10,104,914 B2 10/2018 Force
11,274,391 B2 * 3/2022 Seo ..... D06F 37/266
11,408,115 B2 * 8/2022 Tartuferi ..... D06F 37/266
11,479,902 B2 * 10/2022 Kim ..... D06F 39/083
2004/0025544 A1 * 2/2004 Kim ..... D06F 39/083 68/3 R
2004/0187529 A1 * 9/2004 Kim ..... D06F 39/088 68/147
2004/0237603 A1 * 12/2004 Kim ..... D06F 39/083 68/58
2005/0178170 A1 * 8/2005 Kim ..... D06F 37/266 68/3 R
2008/0295547 A1 * 12/2008 Finke ..... F22B 1/284 68/5 R
2009/0249838 A1 * 10/2009 Kim ..... D06F 39/083 68/58
2009/0249840 A1 * 10/2009 Jo ..... D06F 39/088 68/58
2011/0083477 A1 * 4/2011 Kim ..... D06F 37/266 68/140
2011/0088172 A1 * 4/2011 Im ..... D06F 39/088 8/137
2011/0100070 A1 * 5/2011 Kim ..... D06F 39/088 68/200
2011/0146002 A1 * 6/2011 Kim ..... D06F 39/083 8/137
2011/0154580 A1 * 6/2011 Kim ..... D06F 35/005 68/200
2011/0265525 A1 * 11/2011 Gweon ..... D06F 39/088 68/200
2012/0017649 A1 * 1/2012 Kim ..... D06F 37/26 68/139
2013/0263630 A1 * 10/2013 Doh ..... D06F 25/00 68/20
2014/0033449 A1 * 2/2014 Im ..... D06F 37/266 8/137
2014/0299164 A1 * 10/2014 Zhang ..... D06F 33/43 134/199
2014/0352363 A1 * 12/2014 Kim ..... D06F 37/266 239/600
2017/0211223 A1 * 7/2017 Cho ..... D06F 23/06
2017/0241060 A1 * 8/2017 Seong ..... D06F 39/14
2018/0274150 A1 * 9/2018 Hwang ..... D06F 17/12
2018/0282931 A1 * 10/2018 Kim ..... D06F 39/088
2019/0062977 A1 * 2/2019 Park ..... D06F 39/088
2019/0330780 A1 * 10/2019 Jung ..... D06F 37/06
2020/0063316 A1 * 2/2020 Kim ..... D06F 37/04
2020/0141045 A1 * 5/2020 Seo ..... D06F 21/02
2020/0248378 A1 * 8/2020 Kwon ..... D06F 37/266
2020/0248381 A1 * 8/2020 Lee ..... D06F 39/088
2020/0399817 A1 * 12/2020 Tartuferi ..... D06F 23/02

FOREIGN PATENT DOCUMENTS

KR 20-0141004 Y1 5/1999
KR 1999-0045022 A 6/1999
KR 20-0157234 Y1 9/1999
KR 20-0170347 Y1 2/2000
KR 10-2007-0102234 A 10/2007
KR 10-2011-0025566 A 3/2011
KR 10-1154951 B1 6/2012
KR 10-2013-0036041 A 4/2013
KR 10-2017-0099150 A 8/2017
KR 10-2019-0001785 A 1/2019
WO WO-2019004691 A1 * 1/2019 ..... D06F 21/02
WO WO-2019161898 A1 * 8/2019 ..... D06F 23/02
WO WO-2019210973 A1 * 11/2019 ..... D06F 39/028
WO WO-2019210974 A1 * 11/2019 ..... D06F 23/025
WO WO-2021118052 A1 * 6/2021 ..... D06F 39/081

OTHER PUBLICATIONS

Written Opinion for International Application No. PCT/KR2020/014810 dated Feb. 3, 2021.

* cited by examiner

DIAPHRAGM ASSEMBLY AND WASHING MACHINE COMPRISING SAME

This application is a continuation application, under 35 U.S.C. § 111(a), of International Patent Application No. PCT/KR2020/014810, filed on Oct. 28, 2020, which claims the benefit of Korean Patent Application No. 10-2019-0162859, filed on Dec. 9, 2019, in the Korean Intellectual Property Office, the entire disclosures of which are incorporated herein by reference as a part of this application.

BACKGROUND

Field

The present disclosure relates to a diaphragm assembly of a washing machine, and more particularly, to a diaphragm assembly including a supply hose for supplying water into a drum of a drum type washing machine, and a washing machine including the same.

Description of Related Art

In general, a drum type washing machine is an apparatus that obtains washing power by potential energy caused by falls successively generated by rotating the drum of which the central axis is in the horizontal direction and which is formed in a shape of a cylinder in the state in which laundry is mixed with water inside the drum.

Water required for a washing process enters a detergent dissolving device through a water supply valve connected to an external water supply source, and the water passed through the detergent dissolving device and thereby containing a dissolved detergent is supplied into the tub. At this time, the water is supplied by a water supply hose connected between a diaphragm formed in the open side of the tub and the detergent dissolving device.

The water supply hose is made of a rubber material, and connected to the detergent dissolving device and the diaphragm by a clamp achieving sealing by pressing the outer circumference surface of the connection portion.

However, the connection structure of the water supply hose has a possibility that leakage will occur when the clamp is wrongly assembled in a manufacturing process or service process. Such leakage is a problem particularly at the connection portion between the diaphragm and the water supply hose, and, when leakage occurs, leaking water flows between the inner side of the external frame of the washing machine and the outer side of the tub, which may cause a short circuit, etc., as well as corroding the frames and internal components of the washing machine.

Also, because the water supply hose and the clamp are produced separately and then assembled together, manufacturing cost increases due to such single-product production, and the assembly process raises cost of production.

SUMMARY

A washing machine according to a concept of the disclosure includes: a body including a front frame; a tub provided inside the body; a dispenser to supply water to the tub; a diaphragm provided between the tub and the front frame, the diaphragm including a through hole formed on one side; a nozzle to spray the water toward an inside of the tub; and a supply hose formed to surround the nozzle while a portion of the nozzle is inside the through hole of the diaphragm, wherein a first side of the supply hose is formed to be coupled with the dispenser, and a second side of the supply hose is formed to extend toward an inside of the diaphragm through the through hole.

The diaphragm may include: a protrusion formed around the through hole to surround a portion of the supply hose; and a side wall formed to extend outward from an outer surface of the protrusion.

The second side of the supply hose may include: a first extension having a portion formed to be in contact with an inner surface of the protrusion of the diaphragm; and a second extension formed to be bent from the first extension, and extend along an inner surface of the side wall of the diaphragm.

The first extension of the supply hose may include a guide rib formed to protrude from an outer surface, be in contact with one end of the protrusion of the diaphragm, and be fixed to the diaphragm.

The first extension of the supply hose may comprise a coupling groove, coupleable with the nozzle, on one side of an inner surface of the first extension The nozzle may include: a first member formed to be provided on the inner surface of the first extension of the supply hose and extend along the first extension; and a second member formed to be connected to the first member, and extend along the second extension of the supply hose, and be fixed to the supply hose.

A projection may be formed at one side of an outer surface of the first member of the nozzle, and the projection may be formed to protrude toward the coupling groove to be coupled with the coupling groove.

The nozzle may further include a third member formed to extend from a connection portion of the first member and the second member of the nozzle, and be inclined downward toward the tub, and guide water to be supplied to the tub.

The supply hose may comprise at least one rib formed at a portion of the supply hose on an outer surface and be in contact with the body, the portion formed to face the body, to prevent the supply hose from colliding with the body.

The at least one rib may be a first rib provided at a portion of the supply hose, the portion facing the front frame, and a second rib may be provided at a portion of the supply hose, the portion formed to face a side frame of the body.

Each of the first rib and the second rib may be in a shape of a bar.

Each of the first rib and the second rib may be formed to extend along a direction that is perpendicular to an extension direction of the supply hose, and may be among a plurality of ribs spaced a preset distance from each other.

A washing machine according to another concept of the disclosure includes: a body; a tub provided inside the body; a diaphragm including a side wall that has a through hole on one side, and a protrusion formed to extend upward from the side wall; a nozzle formed to be connected to the diaphragm, and spray water toward an inside of the tub; and a supply hose formed to be coupled with an inner surface of the diaphragm and surround the nozzle while a portion of the nozzle is inside the through hole of the diaphragm.

The supply hose may include: a first extension having a portion formed to be in contact with an inner surface of the protrusion of the diaphragm; and a second extension formed to be bent from the first extension, and extend along an inner surface of the side wall of the diaphragm.

The first extension may include a guide rib formed to protrude from an outer surface, be in contact with one end of the protrusion of the diaphragm, and be fixed to the diaphragm.

A groove portion into which the protrusion is insertable and fixed to may be formed between the guide rib and the second extension.

A coupling groove for coupling with the nozzle may be provided in one side of an inner surface of the first extension.

A diaphragm assembly according to a concept of the disclosure, the diaphragm assembly provided between a front frame of a body of a washing machine and a tub installed inside the body, includes: a diaphragm provided between the tub and the front fame, the diaphragm including a through hole formed on one side of the diaphragm; a nozzle to spray the water toward an inside of the tub; and a supply hose formed to surround the nozzle while a portion of the nozzle is inside the through hole, wherein a first side of the supply hose is formed to be coupled with the dispenser, and a second side of the supply hose is formed to be toward an inside of the diaphragm through the through hole.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
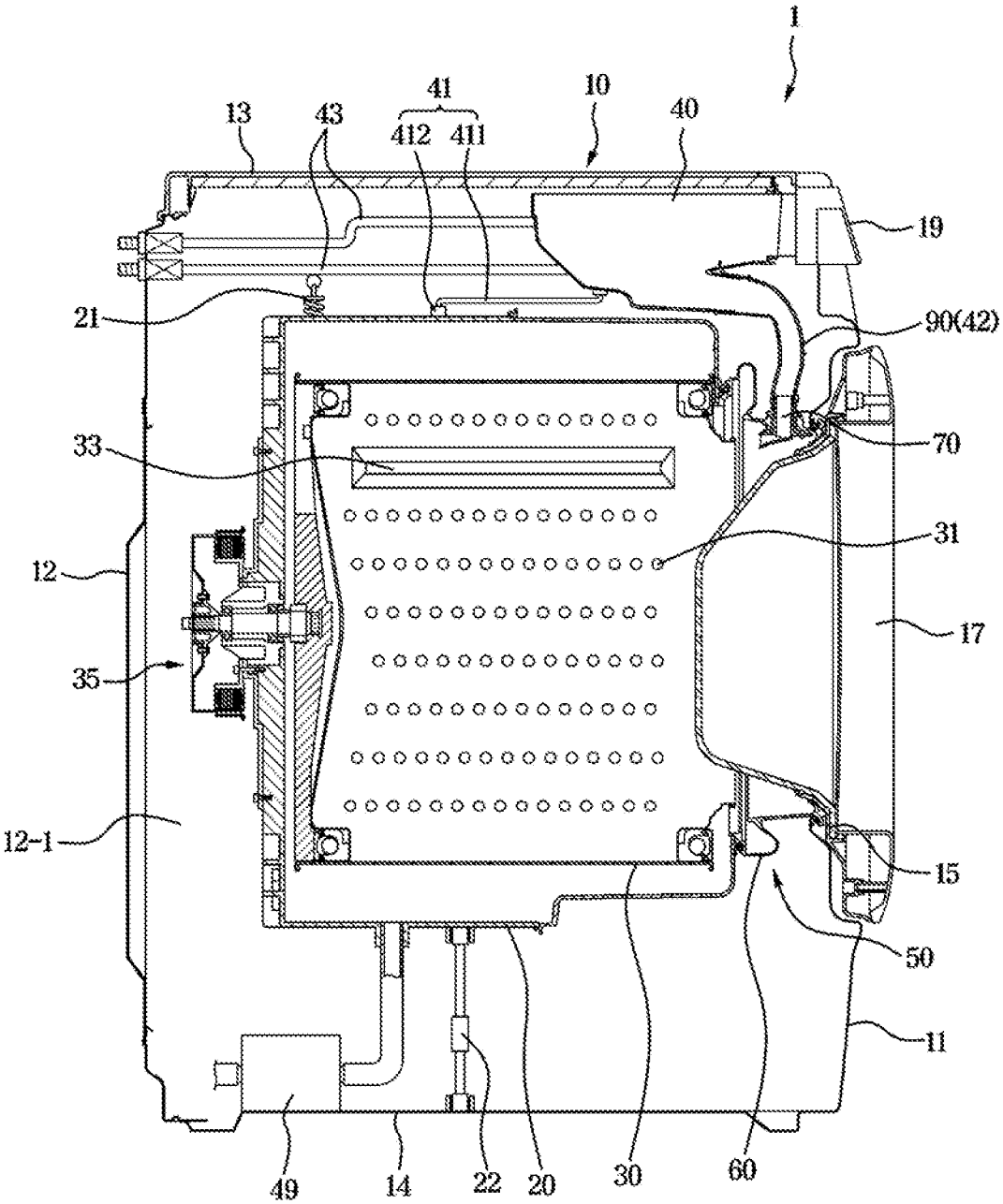
FIG. 1 is a cross-sectional view showing a washing machine according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, an embodiment of the disclosure will be described in detail with reference to the accompanying drawings.

An aspect of the disclosure provides a diaphragm assembly capable of preventing water from leaking out of a diaphragm during washing by structurally preventing poor assembling of the diaphragm and a supply hose, and a washing machine including the diaphragm assembly.

Also, there are provided a diaphragm assembly capable of preventing a supply hose from colliding with a body by vibrations transferred from a drum to a diaphragm during washing to generate noise, and a washing machine including the diaphragm assembly.

The diaphragm assembly and the washing machine including the same, according to a concept of the disclosure, may prevent water from leaking out of the diaphragm during washing by structurally preventing poor assembling of the diaphragm and the supply hose.

Also, it may be possible to prevent the supply hose from colliding with the front frame by vibrations transferred from the drum to the diaphragm during washing to generate noise.

Particularly, by forming the rib having a relatively smaller area than the supply hose on the outer surface of the supply hose such that the rib contacts the body, it may be possible to effectively prevent noise from being generated by a collision and prevent the supply hose from being worn down.

Furthermore, because it is unnecessary to manufacture a clamp, a process of assembling a clamp with the supply hose may be not needed. Accordingly, manufacturing cost may be reduced and efficiency of a manufacturing process may be improved.

Figure 2:
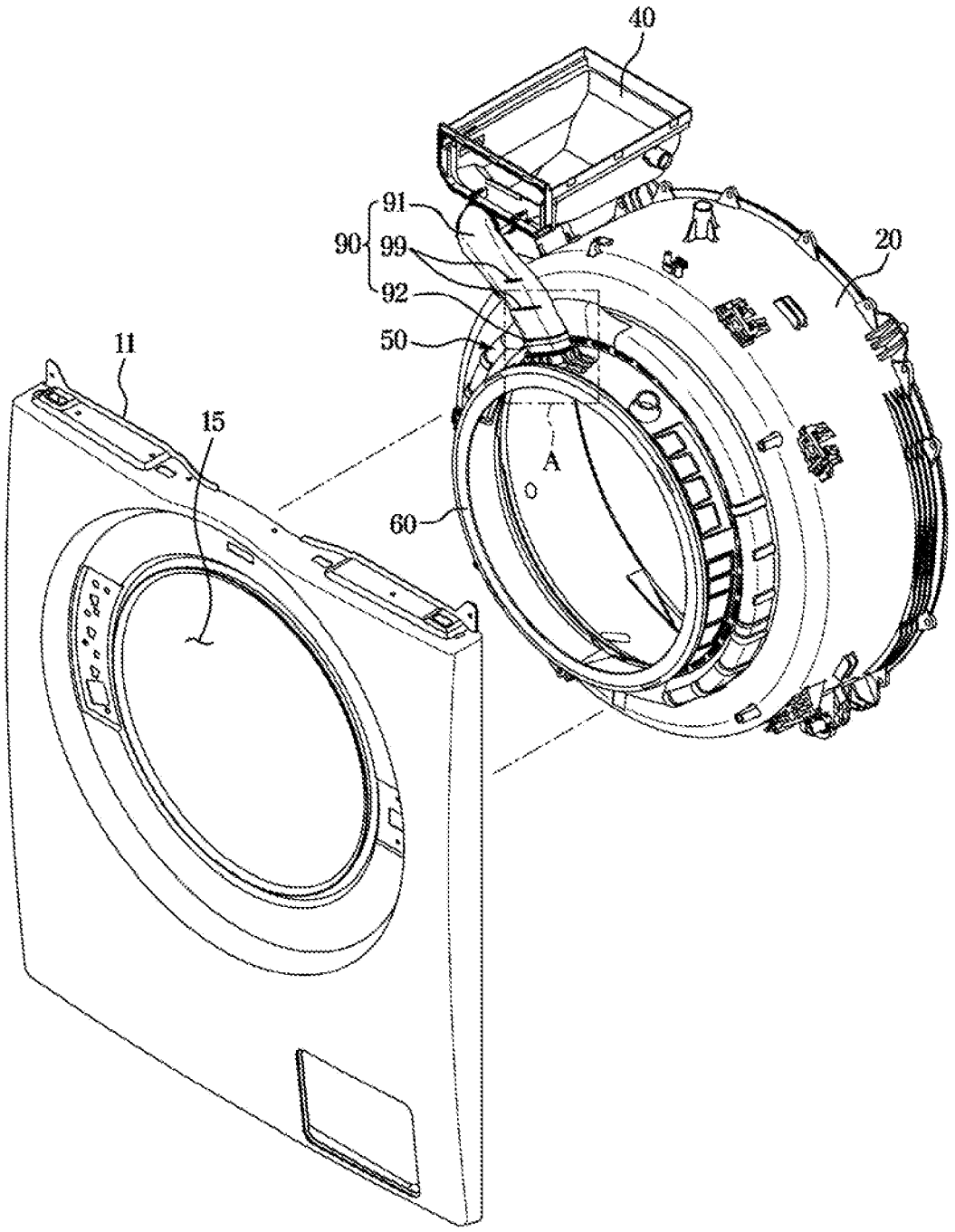
FIG. 2 is a perspective view showing a front frame and a diaphragm assembly coupled with a tub in the washing machine of FIG. 1 according to an embodiment of the disclosure.
Figure 3:
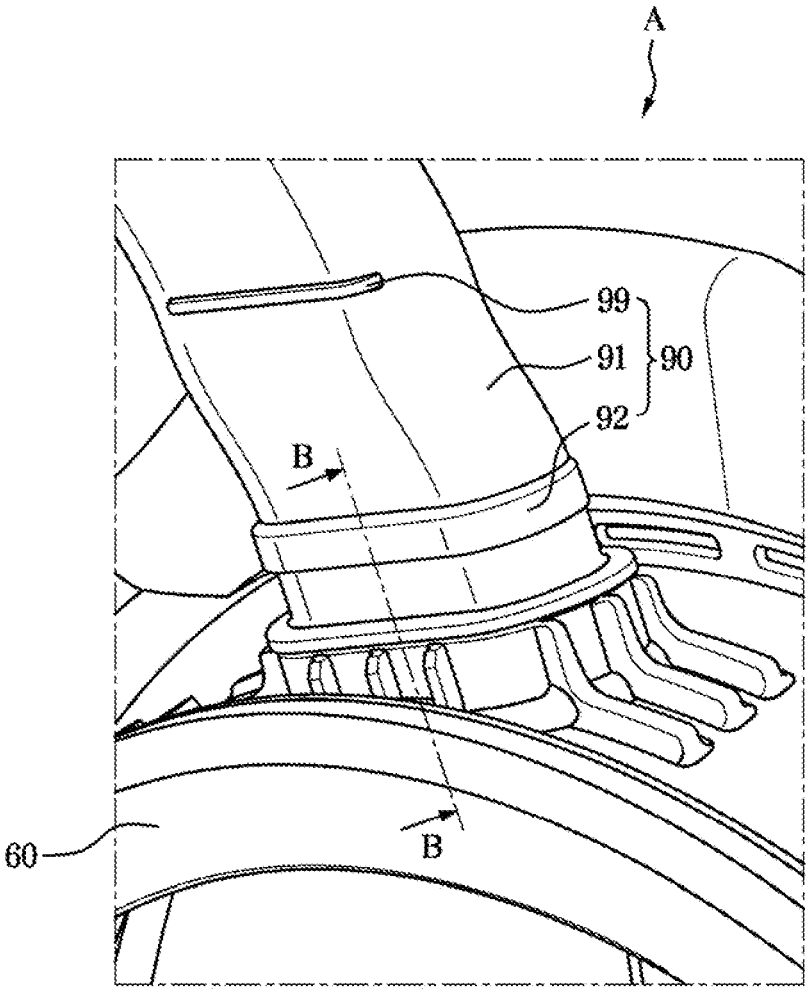
FIG. 3 is an enlarged view showing an 'A' portion of FIG. 2 according to an embodiment of the disclosure.
Figure 4:
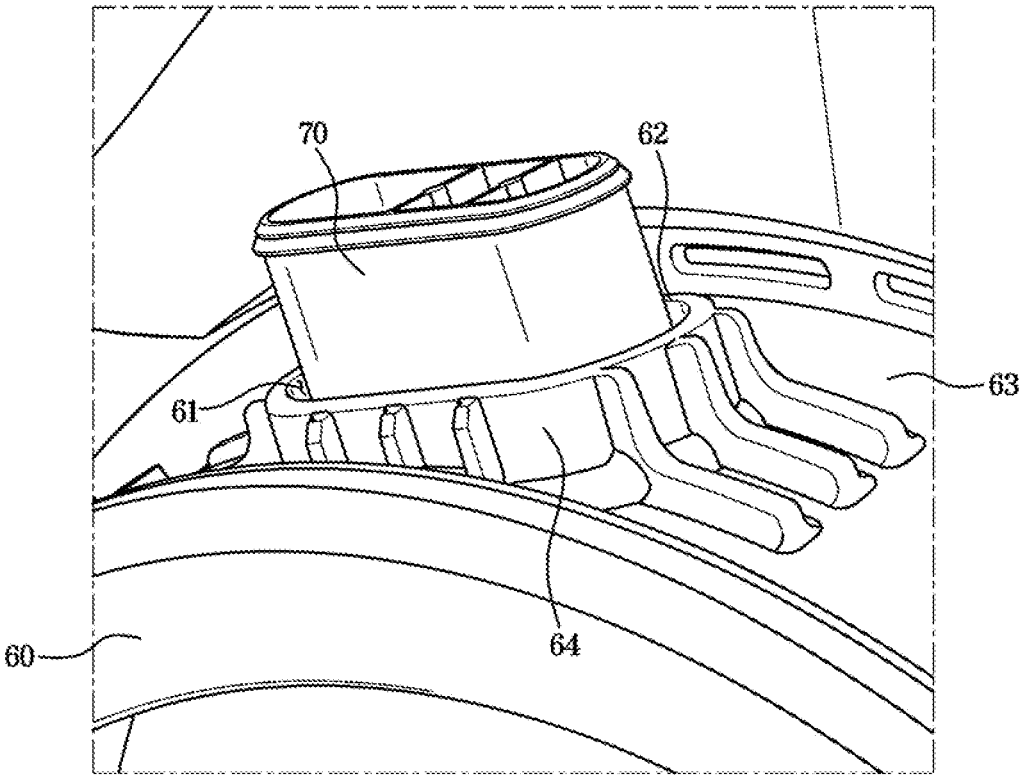
FIG. 4 is a perspective view showing the diaphragm assembly of FIG. 3 when a supply hose is excluded according to an embodiment of the disclosure.
Figure 5:
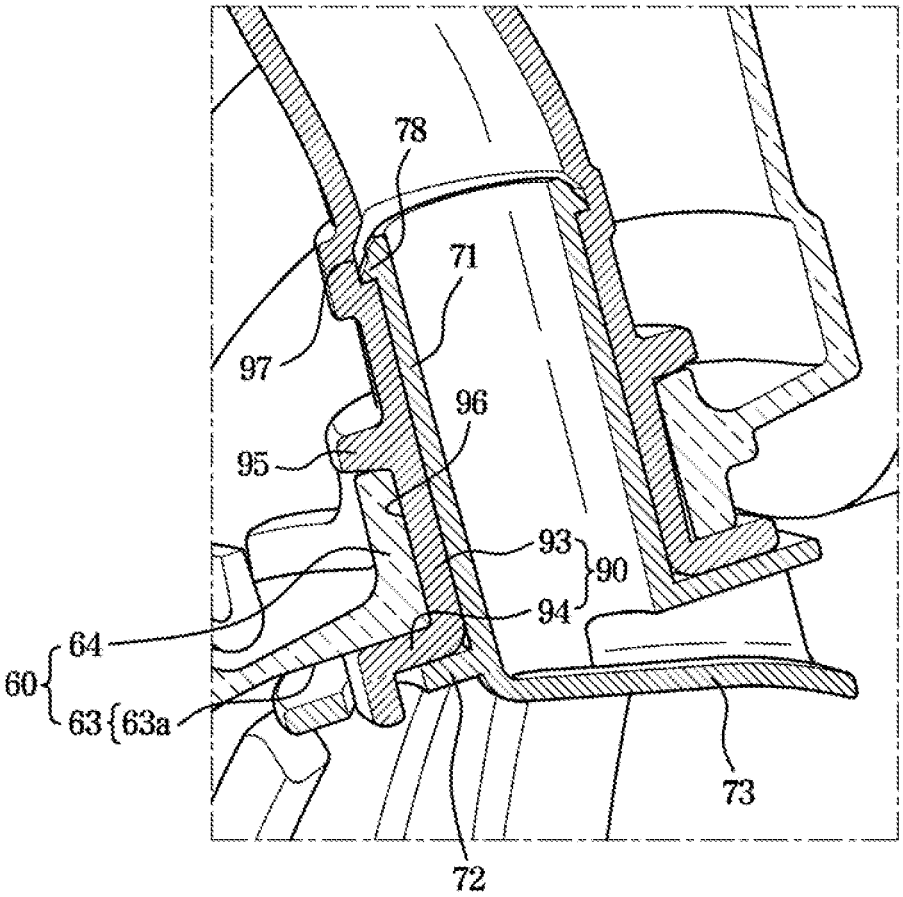
FIG. 5 is a perspective view showing the diaphragm assembly of FIG. 3, taken along line B-B' according to an embodiment of the disclosure.
Figure 6:
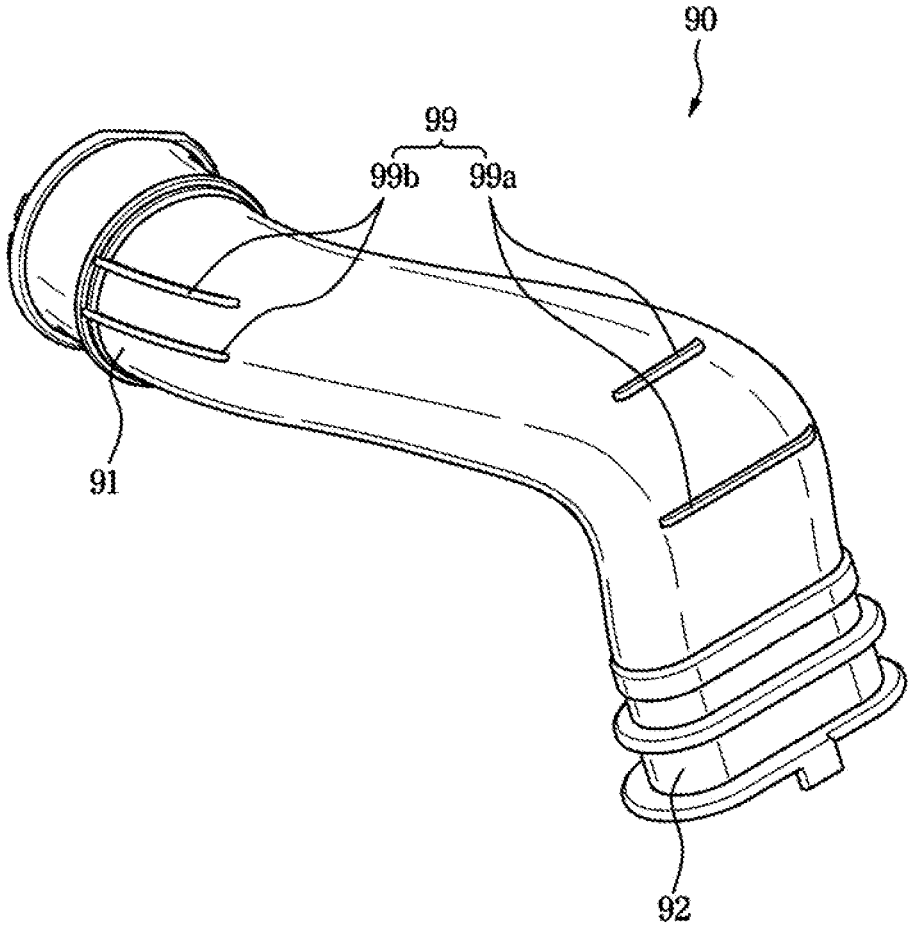
FIG. 6 is a perspective view showing the supply hose of the diaphragm assembly of FIG. 2 according to an embodiment of the disclosure.

FIG. 1 is a cross-sectional view showing a washing machine according to an embodiment of the disclosure, FIG. 2 is a perspective view showing a front frame and a diaphragm assembly coupled with a tub in the washing machine of FIG. 1, FIG. 3 is an enlarged view showing an 'A' portion of FIG. 2, FIG. 4 is a perspective view showing the diaphragm assembly of FIG. 3 when a supply hose is excluded, FIG. 5 is a perspective view showing the diaphragm assembly of FIG. 3, taken along line B-B', and FIG. 6 is a perspective view showing the supply hose of the diaphragm assembly of FIG. 2.

Referring to FIGS. 1 and 2, the washing machine 1 may include a body 10, a tub 20, a drum 30, and a diaphragm assembly 50.

The body 10 may form an outer appearance of the washing machine 1, and may be formed substantially in a shape of a rectangular parallelepiped. The body 10 may include a front frame 11, a rear frame 12, side frames 12-1 including a left frame and a right frame, an upper frame 13, and a lower frame 14.

In the front frame 11 of the body 10, a laundry entrance 15 through which laundry is put/taken into/out of the body 10 may be provided. In the laundry entrance 15, a door 17 may be installed to be opened or closed. In an upper portion of the front frame 11 of the body 10, a control panel 19 for controlling the washing machine 1 may be provided.

The tub 20 may be installed inside the body 10 of the washing machine 1, and formed in a shape of a cylinder having an opening toward the laundry entrance 15 of the front frame 11. The tub 20 may store water required for washing. The tub 20 may be supported and fixed on the body 1 by a tension spring 21, an oil damper 22, etc.

The drum 30 may be rotatably installed inside the tub 20, and formed in a shape of a hollow cylinder. The drum 30 may include an opening corresponding to the laundry entrance 15 of the body 10 of the washing machine 1, and a plurality of through holes 31 formed in the surface. Also, a plurality of lifts 33 for raising laundry may be provided on an inner surface of the drum 30. The drum 30 may rotate on a horizontal axis by a driving device including a driving motor 35 installed on the rear surface.

A dispenser 40 for supplying water to the tub 20 may be provided above the tub 20, and a drain device 49 for draining water from the tub 20 to outside may be installed below the tub 20.

The dispenser 40 may supply water to the tub 20 through two paths, that is, a first water supply path 41 and a second water supply path 42. The dispenser 40 may be connected to a water supply pipe 43 protruding out of the body 10. Accordingly, by connecting an external water supply, for example, a public water supply to the water supply pipe 43 of the body 10, the dispenser 40 may supply water to the tub 20. The dispenser 40 may supply water to the tub 20 through the first water supply path 41 and the second water supply path 42 according to a control of the control panel 19.

The first water supply path 41 may supply water to the inside of the tub 20 from above the tub 20. Accordingly, in an upper side of the tub 20, a water supply pipe 412 connected to one end of a hose 411 for supplying water may be provided. The other end of the hose 411 may be connected to the dispenser 40.

The second water supply path 42 may supply water to the inside of the tub 20 through the diaphragm 60 installed in a front end of the tub 20. That is, the second water supply path 42 may be provided in the diaphragm assembly 50.

The diaphragm assembly 50 may be installed between the tub 20 and the front frame 11 of the body 10. More specifically, the diaphragm assembly 50 may be installed between one end of the tub 20, having the opening corresponding to the laundry entrance 15, and the laundry entrance 15 of the front frame 11.

More specifically, the diaphragm assembly 50 may include a diaphragm 60, a nozzle 70, and a supply hose 90.

The diaphragm 60 may be installed between the tub 20 and the front frame 11 of the body 10, and formed substantially in a shape of a ring. One end of the diaphragm 60 may be fixed on the end of the tub 20 where the opening is provided, and the other end of the diaphragm 60 may be fixed on an inner circumference of the laundry entrance 15 of the front frame 11 of the body 10. The diaphragm 60 may prevent water accommodated in the tub 20 from leaking out of the tub 20, and form a path through which laundry passes. Also, the diaphragm 60 may prevent vibrations generated when the drum 30 rotates from being transferred to the front frame 11 of the body 10 via the tub 20. The diaphragm 60 may be formed of rubber to reduce vibrations.

Meanwhile, referring to FIGS. 3 to 5, a through hole 61 in which the nozzle 70 is inserted may be formed in one side of the diaphragm 60. More specifically, the diaphragm 60 may include a protrusion 64 formed around the through hole 61, and a side wall 63 extending outward from an outer surface of the protrusion 64. Herein, the side wall 63 may extend in a diameter direction of the through hole 61 from the outer surface of the protrusion 64, and the protrusion 64 may extend in a vertical direction from the side wall 63 to have a preset height from the side wall 63 to a top 62 of the protrusion 64 and surround a portion of the supply hose 90.

The nozzle 70 may be inserted into the through hole 61. That is, a portion of the nozzle 70 may be positioned inside the through hole 61. The nozzle 70 may supply water (water) into the tub 20, and may be coupled with the supply hose 90 for supplying water.

The supply hose 90 may surround the nozzle 70 inside the through hole 61. A portion of the supply hose 90, surrounding the nozzle 70, may be positioned on an inner surface of the diaphragm 60.

The supply hose 90 may include a first side 91 coupled with the dispenser 40, and a second side 92 coupled with an inner surface of the through hole 61 of the diaphragm 60. The supply hose 90 may move water provided from the dispenser 40 from the first side 91 toward the second side 92.

In this case, the second side 92 of the supply hose 90 may include a first extension 93 and a second extension 94.

A portion of the first extension 93 may be in contact with an inner surface of the protrusion 64. That is, the first extension 93 may be in contact with the inner surface of the protrusion 64 from an inner surface of one end of the protrusion 64 to an inner surface of the other end of the protrusion 64. Also, the first extension 93 may surround the nozzle 70 located therein.

The second extension 94 may extend from the first extension 93, and extend along an inner surface 63*a* of the side wall 63. The second extension 94 may be connected to the first extension 93 and extend along the inner surface 63*a* of the side wall 63, thereby fixing and supporting the supply hose 90 on the inner surface 63*a* of the side wall 63.

As described above, by coupling the second side 92 of the supply hose 90 directly with the inner surface of the diaphragm 60 and fixing the nozzle 70 onto an inner surface of the supply hose 90, no gap may be formed between the supply hose 90 and the diaphragm 60, and leakage between the supply hose 90 and the nozzle 70 may be prevented. That is, water may be prevented from leaking out at a connection portion between the diaphragm 60 and the supply hose 90. Accordingly, it may be possible to prevent leaking water from flowing between the front frame 11 of the washing machine 1 and an outer side of the tub 20 to corrode the front frame 11 and internal components of the washing machine 1.

Moreover, the first extension 93 may include a guide rib 95 protruding from the outer surface and being in contact with one end of the protrusion 64. The guide rib 95 may be in contact with the one end of the protrusion 65 to prevent the supply hose 90 from moving in a downward direction, that is, a direction toward the inside of the diaphragm 60, while fixing the supply hose 90 on the diaphragm 60. In other words, a groove portion 96 may be formed between the guide rib 95 and the second extension 94, and in this case, the protrusion 64 of the diaphragm 60 may be inserted into the groove portion 96 to more firmly fix the supply hose 90 to the diaphragm 60.

Furthermore, a coupling groove 97 for coupling with the nozzle 70 may be formed in one side of an inner surface of the first extension 93. The coupling groove 97 may be provided at a higher location than the guide rib 95 with respect to the through hole 61. A projection 78 may be formed on an outer surface of the nozzle 70, and the projection 78 may be provided at a location corresponding to the coupling groove 97 to be coupled with the coupling groove 97. Accordingly, by coupling the protrusion 78 formed on the outer surface of the nozzle 70 with the coupling groove 97 of the first extension 93, the nozzle 70 may be more stably coupled with the supply hose 90 without moving.

More specifically, the nozzle 70 may include a first member 71, a second member 72, and a third member 73.

The first member 71 may be provided on the inner surface of the first extension 93 along the first extension 93. The projection 78 protruding toward the coupling groove 97 to be coupled with the coupling groove 97 may be formed at one side of an outer surface of the first member 71.

The second member 72 may extend from an end of the first member 71 along the second extension 94, and be fixed to the supply hose 90. That is, the second member 72 may be connected to the first member 71 and extend along the second extension 94, thereby more stably fixing and supporting the nozzle 70 to the supply hose 90.

The third member 73 may extend from a connection portion of the first member 71 and the second member 72 to guide water to be supplied to the tub 20. In this case, the third member 73 may be inclined downward toward the tub 20.

Meanwhile, during dehydration of the washing machine 1, the supply hose 90 may collide with the body 10 of the washing machine 1 by vibrations transferred to the diaphragm 60 to generate noise. To prevent this, referring to FIG. 6, at least one rib 99 may be provided on an outer surface of the supply hose 90.

A first rib 99*a* may be provided at a portion of the supply hose 90, facing the front frame 11. Particularly, the first rib 99*a* may be provided at a bent portion of the supply hose 90 to face the front frame 11. A second rib 99*b* may be provided at a portion of the supply hose 90, facing the side frame 12-1. In this case, the second rib 99*b* is shown to be provided at the left frame, in the drawing. However, the second rib 99*b* may be provided at the right frame.

When vibrations are generated in the diaphragm 60, the first rib 99*a* may contact the front frame 11, and the second rib 99*b* may contact the left frame 12-1.

Accordingly, the supply hose 90 may be prevented from directly contacting and colliding with the front frame 11 and the left frame 12-1, and the supply hose 90 may be prevented from rubbing the front frame 11 and the left frame 12-1 to be worn down.

Meanwhile, the first rib 99*a* and the second rib 99*b* may extend to have a shape of a bar. For example, each of the first rib 99*a* and the second rib 99*b* may extend in a direction that is perpendicular to an extension direction of the supply hose 90. Because each of the first rib 99*a* and the second rib 99*b* formed in this way has a smaller area than that of the supply hose 90, each of the first rib 99*a* and the second rib 99*b* may contact the body 10 at a relatively smaller area than the supply hose 90, thereby reducing noise generated by a collision with the body 10.

Moreover, to more effectively reduce noise generated by a collision with the body 10, each of the first rib 99*a* and the second rib 99*b* may be provided as a plurality of ribs spaced a preset distance from each other on the outer surface of the supply hose 90. For example, each of the first rib 99*a* and the second rib 99*b* may be provided as a pair of ribs, as shown in FIG. 6.

Furthermore, a surface of each of the first rib 99*a* and the second rib 99*b*, facing the front frame 11, may be formed as a curved surface having a curvature to thereby effectively reduce noise generated by rubbing the front frame 11.

The scope of rights of the disclosure is not limited to the above-described specific embodiments, and it is obvious that various other embodiments corrected or modified by those having ordinary skill in the technical field belong to the scope of rights of the disclosure without departing from the gist as the technical concept of the disclosure set forth in the claims.

What is claimed is:

1. A washing machine comprising:

a body including a front frame;

a tub arrangeable inside the body;

a dispenser to supply water to the tub while the tub is arranged inside the body;

a diaphragm arrangeable between the tub and the front frame, the diaphragm including a through hole formed on one side;

a nozzle to spray the water toward an inside of the tub, the nozzle being arrangeable inside the through hole of the diaphragm; and a supply hose formed to surround the nozzle such that while a portion of the nozzle is arranged inside the through hole of the diaphragm, the supply hose is between the diaphragm and the portion of the nozzle, wherein a first side of the supply hose is formed to be coupled with the dispenser, and a second side of the supply hose is formed to extend toward an inside of the diaphragm through the through hole.

2. The washing machine of claim 1, wherein the diaphragm comprises:

a protrusion formed around the through hole to surround a portion of the supply hose; and a side wall formed to extend outward from an outer surface of the protrusion.

3. The washing machine of claim 2, wherein the second side of the supply hose comprises:

a first extension having a portion formed to be in contact with an inner surface of the protrusion of the diaphragm; and a second extension formed to be bent from the first extension, and extend along an inner surface of the side wall of the diaphragm.

4. The washing machine of claim 3, wherein the first extension of the supply hose comprises a guide rib formed to protrude from an outer surface, be in contact with one end of the protrusion of the diaphragm, and be fixed to the diaphragm.

5. The washing machine of claim 3, wherein the first extension of the supply hose comprises a coupling groove, coupleable with the nozzle, on one side of an inner surface of the first extension.

6. The washing machine of claim 5, wherein the nozzle comprises:

a first member formed to be provided on the inner surface of the first extension of the supply hose and extend along the first extension; and a second member formed to be connected to the first member, and extend along the second extension of the supply hose, and be fixed to the supply hose.

7. The washing machine of claim 6, wherein a projection is formed at one side of an outer surface of the first member of the nozzle, and the projection is formed to protrude toward the coupling groove to be coupled with the coupling groove.

8. The washing machine of claim 6, wherein the nozzle further comprises a third member formed to extend from a connection portion of the first member and the second member of the nozzle, and be inclined downward toward the tub, and guide water to be supplied to the tub.

9. The washing machine of claim 1, wherein the supply hose comprises at least one rib formed at a portion of the supply hose on an outer surface and be in contact with the body, the portion of the supply hose formed to face the body, to prevent the supply hose from colliding with the body.

10. The washing machine of claim 9, wherein the at least one rib is a first rib provided at a first portion of the supply hose, the first portion of the supply hose formed to face the front frame, and a second rib is provided at a second portion of the supply hose, the second portion formed to face a side frame of the body.

11. The washing machine of claim 10, wherein each of the first rib and the second rib is in a shape of a bar.

12. The washing machine of claim 11, wherein each of the first rib and the second rib is formed to extend along a direction that is perpendicular to an extension direction of the supply hose, and is among a plurality of ribs spaced a preset distance from each other.

13. A washing machine comprising:

a body;

a tub arrangeable inside the body;

a diaphragm including a side wall that has a through hole on one side, and a protrusion formed to extend upward from the side wall;

a nozzle formed to be connected to the diaphragm, and spray water toward an inside of the tub, the nozzle being arrangeable inside the through hole of the diaphragm; and a supply hose formed to be coupled with an inner surface of the diaphragm and surround the nozzle such that while a portion of the nozzle is arranged inside the through hole of the diaphragm, the supply hose is between the diaphragm and the portion of the nozzle.

14. The washing machine of claim 13, wherein the supply hose comprises:

a first extension having a portion formed to be in contact with an inner surface of the protrusion of the diaphragm; and a second extension formed to be bent from the first extension, and extend along an inner surface of the side wall of the diaphragm.

15. The washing machine of claim 14, wherein the first extension comprises a guide rib formed to protrude from an outer surface, be in contact with one end of the protrusion of the diaphragm, and be fixed to the diaphragm.

* * * * *